United States Patent [19]

Wöhrl et al.

[11] Patent Number: 4,735,260

[45] Date of Patent: Apr. 5, 1988

[54] APPARATUS FOR SEALING THE LEAKAGE GAP BETWEEN THE U-SHAPED BENDS OF A TUBE MATRIX AND THE FACING GUIDE WALL OF A HEAT EXCHANGER

[75] Inventors: Bernhard Wöhrl, Gauting; Klaus Hagemeister, Munich, both of Fed. Rep. of Germany

[73] Assignee: Motoren- und Turbinen-Union Munchen GmbH, Munich, Fed. Rep. of Germany

[21] Appl. No.: 853,474

[22] Filed: Apr. 18, 1986

[30] Foreign Application Priority Data

Apr. 20, 1985 [DE] Fed. Rep. of Germany ..... 3514379

[51] Int. Cl.[4] ..... F28F 9/22; F28D 7/06

[52] U.S. Cl. ..... 165/69; 165/81; 165/159; 165/163; 165/135

[58] Field of Search ..... 165/69, 81, 135, 159

[56] References Cited

U.S. PATENT DOCUMENTS

| | | | |
|---|---|---|---|
| 1,964,256 | 6/1934 | Fahrenwald | 165/135 X |
| 2,303,247 | 11/1942 | Woods | 165/159 X |
| 3,174,301 | 3/1965 | Thornton et al. | 165/135 X |
| 3,746,083 | 7/1973 | Tiefenbacher | 165/145 X |
| 4,102,602 | 7/1978 | Rottenkolber | 416/221 |
| 4,216,937 | 8/1980 | Bridgweil et al. | 165/69 X |
| 4,475,586 | 10/1984 | Grieb et al. | 165/145 X |
| 4,586,564 | 5/1986 | Hagemeister | 165/159 |

FOREIGN PATENT DOCUMENTS

| | | | |
|---|---|---|---|
| 2000886 | 7/1971 | Fed. Rep. of Germany . | |
| 2828275 | 1/1980 | Fed. Rep. of Germany | 165/159 |
| 328740 | 3/1929 | United Kingdom | 165/81 |
| 0490727 | 8/1938 | United Kingdom | 165/159 |

*Primary Examiner*—Albert W. Davis, Jr.

*Attorney, Agent, or Firm*—Roberts, Spiecens & Cohen

[57] ABSTRACT

Apparatus for effecting heat exchange between first and second fluids in a heat exchanger in which a first fluid is conveyed through a plurality of spaced U-shaped tubes assembled in a matrix of the heat exchanger, and a second fluid is conveyed around the tubes of the matrix in a direction perpendicular to the matrix so that heat exchange takes place between the first and second fluids. The U-shaped tubes have bends facing a guide wall of the heat exchanger and form a gap therebetween to permit relative movement of the tubes and the guide wall, for example, due to differential thermal expansion and vibration. Flow of the second fluid through the gap is blocked by a resilient sealing element which resiliently accommodates the relative movement of the tubes with respect to the guide wall and damps vibration. The sealing element can be a flexible mat of elastic metal felt.

17 Claims, 5 Drawing Sheets

APPARATUS FOR SEALING THE LEAKAGE GAP BETWEEN THE U-SHAPED BENDS OF A TUBE MATRIX AND THE FACING GUIDE WALL OF A HEAT EXCHANGER

FIELD OF THE INVENTION

The invention relates to heat exchangers and more particularly to improvements in heat exchangers of the type comprising a plurality of U-shaped tubes assembled in internested spaced relation in a matrix for conveying a first fluid through the tubes in which a second fluid flows across the tubes to effect heat exchange with the first fluid.

The invention is particularly related to the construction which prevails between the bends of the tubes and the facing wall of the housing.

RELATED APPLICATION

Ser. No. 677,190 filed Dec. 3, 1984 now No. U.S. Pat. No. 4,586,564 relates to a heat exchanger, similar to that to which the present invention has been applied and is directed to mechanical connections between the tubes of the matrix and the adjoining wall of the housing.

PRIOR ART

Heat exchangers of this type, are disclosed, for example, in U.S. Pat. No. 4,475,586 where there is shown a cover or guide wall around the bend portions of the tubes of the matrix. Conventionally, the cover walls are constructed as metal vanes conforming to the curved outer contour of the tube bends where the fluid in the tubes undergoes reversal. Since the guide wall forms a portion of the casing or housing structure enveloping the tube matrix of the heat exchanger whose temperature and expansion differ from that of the tube matrix, such a construction makes it necessary to provide a suitable spacing or gap between the metal vanes and the bends of the tubes of the matrix, so that the tubes are freely displaceable.

As a consequence, the hot gases flowing around the tube matrix can have a relatively large leakage flow in the gap. This produces two notable disadvantages impairing the effectivity of the heat exchanger.

One is the hot gas leakage flow does not participate in the heat exchange process, and two is that at the outlet of the gap, the leakage flow is discharged at a relatively high velocity into the main gas flow through the matrix, causing turbulence and severe irregularities of flow. Together, these disadvantages are the cause of a relatively severe reduction in heat exchange efficiency.

In another heat exchanger disclosed in U.S. Pat. No. 3,746,083 the wall around the bends of the tubes forms a fixed part of the casing carrying the hot gases and U-shaped sealing bars are engaged against the bends of the tubes to bridge the gap between the wall and the tube bends. While this construction operates to partially seal the outer hot gas leakage gap, it also causes an undefined heat exchange process in the area of the tube bends. A hot gas flow carried homogenously along the outer surfaces of the tube bends therefore is not ensured. Moreover, there is no consideration of the thermally produced differential expansions in the area between the tube bends themselves and between the tube matrix and the casing or guide wall. In the prior art as described above, operationally induced relative movement of the tube matrix causing tube vibrations and deflections are not considered and no construction is disclosed for compensating such relative movements of the tube matrix while damping its vibrations.

SUMMARY OF THE INVENTION

An object of the present invention is to provide an apparatus which eliminates the above noted disadvantages and provides a heat exchanger in which the relative movements of the tubes with respect to one another and with respect to the casing structure enclosing the matrix can be accommodated, especially at the bends of the tube matrix and further in which the bends of the tubes can participate in the heat exchanging process without adversely affecting the homogeneity of the discharged hot gases at the outlet of the tube matrix.

In order to satisfy the above and further objects of the invention, there is provided means including a flexible elastic sealing element between the guide wall of the housing or casing structure and the bends of the tubes of the matrix for blocking flow of the hot gases through the gap while permitting relative movement of the tubes with respect to one another and with respect to the guide wall.

Additionally, the sealing element which resiliently permits the relative movement of the tubes with respect to one another and with respect to the guide wall also damps vibrations of the tubes.

In further respects, it is contemplated that a portion of the hot gases is permitted to flow into the gap and be conveyed against the bends of the tubes substantially radially thereof. This is achieved by apparatus which permits passage of the hot gases admitted into said gap to flow to the bends of the tubes substantially radially thereof. Hence, instead of leakage flow, normally produced in the prior art, the hot gases are constrained to participate in the heat exchange particularly at the bends of the tube matrix where such heat exchange tends to be less intense.

The sealing element of the present invention serves to compensate for the relative movements of the individual tube bends of the matrix produced by differential temperatures, vibrations or elastic deflections while positively blocking off the leakage gap and achieving intensified heat exchange at the bends by the main flow of hot gases.

BRIEF DESCRIPITION OF THE FIGURES OF THE DRAWING

DETAILED DESCRIPTION OF PREFERRRED EMBODIMENTS

Figure 1:
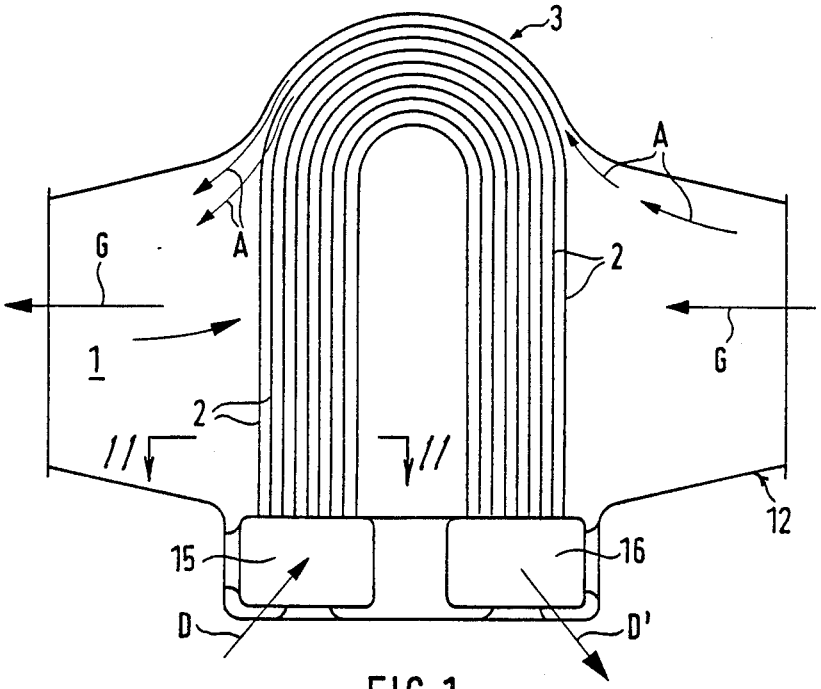
FIG. 1 is a diagrammatic elevational view from one end of a basic heat exchanger to which the construction of the invention is applicable.
Figure 2:
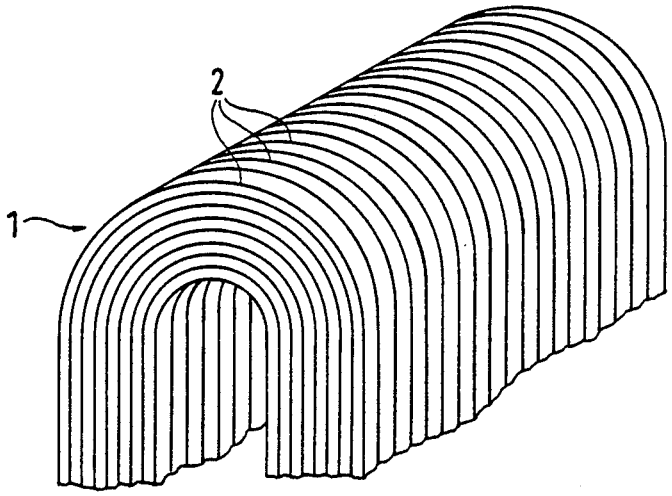
FIG. 2 is a diagrammatic perspective view of a portion of a tube matrix of the heat exchanger in FIG. 1 showing the curved U-portions of the tube matrix.

Referring to FIGS. 1 and 2, therein is seen a heat exchanger which comprises an assembly or matrix 1 of heat exchanger tubes 2 of U-shape which are positioned within a housing or casing 12 such that heated gases G can flow over the tube matrix 1 in the direction of the arrows from an inlet region in the housing on one side of the matrix to an outlet region in the housing on the other side of the matrix.

The U-shaped tubes 2 of the matrix 1 have straight legs respectively connected to inlet and outlet ducts 15,16. The ducts 15 and 16 extend substantially parallel to one another in a direction perpendicular to the flow of hot gases G. The matrix 1 extends along the length of ducts 15 and 16 and projects transversely into the direction of flow of gases G. An operating fluid, such as compressed air, is supplied to the tubes 2 of the matrix at duct 15 as shown at D and the operating fluid flows through the interior of the tubes 2 and is discharged at duct 16 as shown at D'. In the course of travel of the compressed air through the tubes 2, the compressed air is heated by the gases G flowing around the exterior of the tubes so that the compressed air supplied to duct 16 from the tubes 2 is heated.

The U-shaped tubes 2 have curved U-portions or bends connected to the straight legs and the compressed air flowing in the tubes undergoes reversal of direction in the curved U-portions. The curved U-portions of the tubes are surrounded by a limiting guide wall 3 which is connected at its inlet and outlet sides to the housing 12 so as to be integrated therewith.

Figure 11:
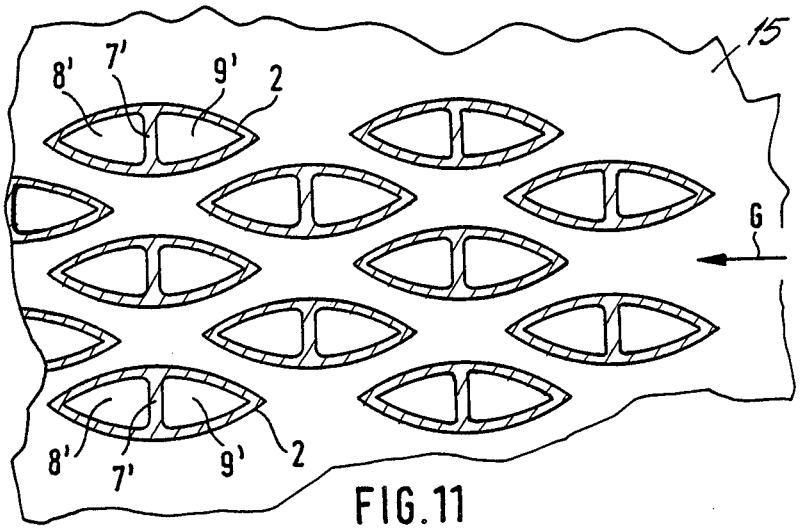
FIG. 11 is a sectional view through a portion of a tube matrix taken along line 11—11 in FIG. 1.

As seen in FIG. 11, the tubes 2 of the matrix 1 are arranged in a field in substantially equally spaced staggered relation in which the tubes internest with one another.

Figure 10:
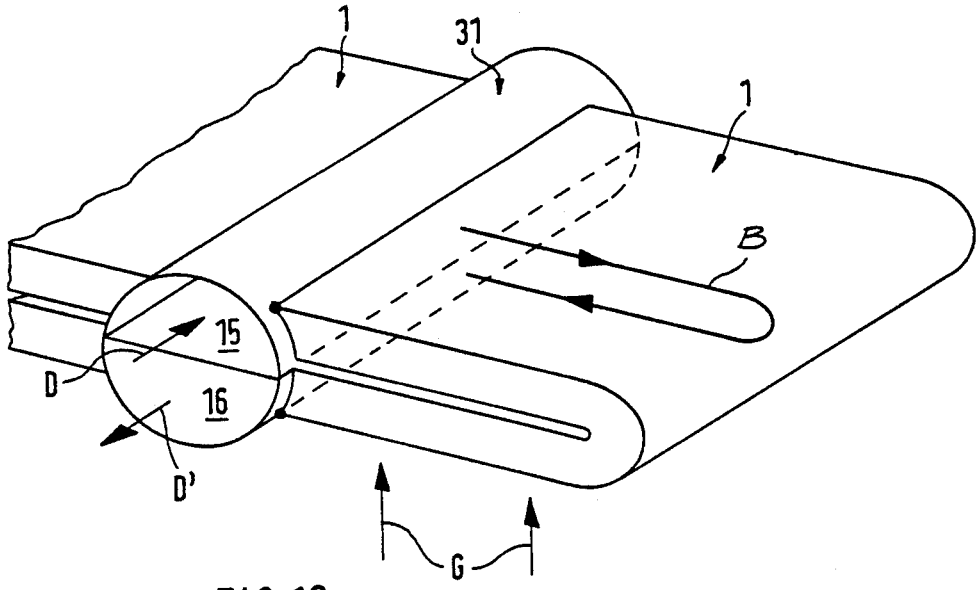
FIG. 10 is a perspective view of a heat exchanger similar to that in FIG. 1 but showing only a modified portion thereof.

The two ducts 15, 16 can be integrated in a common duct or manifold 31 as seen in FIG. 10. Also seen in FIG. 10 is the direction of flow B of compressed air in the tubes of the matrix.

Figure 4:
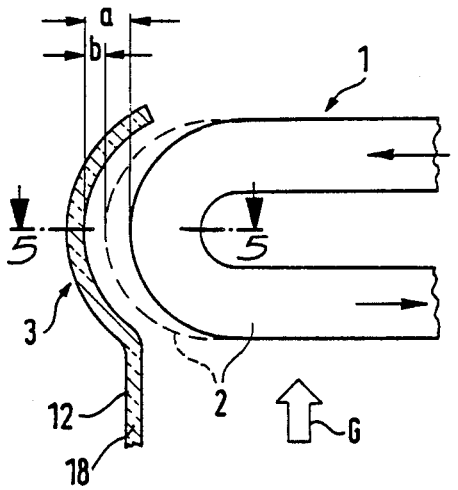
FIG. 4 is a view of the heat exchanger of FIG. 3 in which the first embodiment of the invention has been omitted to show thermally induced expansion of the tube matrix with reference to a wall of the heat exchanger.

As it will become apparent, particularly from FIG. 4, a relatively large gap or spacing is maintained between the wall 3 and the immediately adjacent tubes 2 of the outer row of the matrix. Due to this spacing, a relatively large leakage flow A of hot gases can be produced between wall 3 and the matrix 1. This results in reduced heat exchanging action, because leakage flow A of hot gases, separated from the main flow G of hot gases, essentially flows only through said gap and not around the surface of the tubes in the region of the bends thereof. Moreover, the leakage flow A of hot gases greatly increases in velocity with respect to the main flow G and the added velocity can cause turbulence when the leakage flow rejoins the main flow G causing irregularities in the heat exchange process.

Referring again to FIG. 4, therein it is seen that the bends or curved portions of the outermost row of the tubes 2 of matrix 1 are spaced at a distance a from the guide wall 3 in the cold condition and this distance is reduced during the heat exchange process to distance b. It is necessary to provide a minimum spacing, i.e. distance b, during the hot operating conditions to prevent rubbing contact of the tubes of the matrix against the casing 12 or against the wall 3 particularly where such rubbing contact might cause operationally induced vibrations of the matrix i.e. transient conditions.

The distance a must be established in order to accommodate operationally induced differential expansions of the bends of tubes 2 and wall 3 or free expansion of the bends of the tubes relative to the casing or the wall 3.

Figure 5:
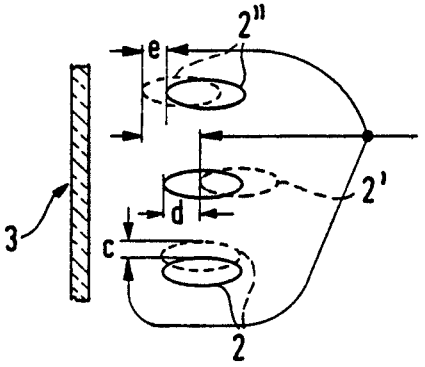
FIG. 5 is a diagrammatic sectional view taken on line 5—5 in FIG. 4 and illustrates the relative movement of individual tubes.

FIG. 5 illustrates variable relative movements which can take place between three adjacent tubes 2, 2', 2'' in the outermost row of the matrix 1. Each tube is shown in solid lines in its original position and in dotted lines in a displaced position. Thus, tube 2 is seen laterally offset by distance c, while tube 2' is displaced by distance d away from the wall 3 and tube 2'' is displaced by distance e towards the wall 3. It is to be understood that each tube can undergo any combination of displacement c, d, e relative to one another or to wall 3.

In order to solve the problem of leakage flow while providing clearance of the tube bends with the guide wall 3 and while permitting relative movement of the tubes within the matrix and with respect to the wall, the hot gas leakage gap between the bends of the tubes matrix 1 and the adjacent wall 3 is closed off by at least one flexible, resilient sealing element 17. The sealing element 17 serves to minimize heat losses by blocking the leakage flow A of hot gases and by producing a flow of gases G' in the region of the bends of the tubes 2. More particularly, the flow of gases G' only slightly deviates from the main flow G and freely travels around the bends of tubes 2 of the matrix.

The sealing element 17 serves the further function of accommodating differing thermal expansions between the bends of the tubes and the cooled, or insulated casing 12 and wall 3 as explained previously with reference to FIG. 4. The sealing element 17 also accommodates relative movements of the bends of the tubes as a result of differing temperatures, vibrations or elastic deflections as was previously explained with reference to FIG. 5.

Figure 3:
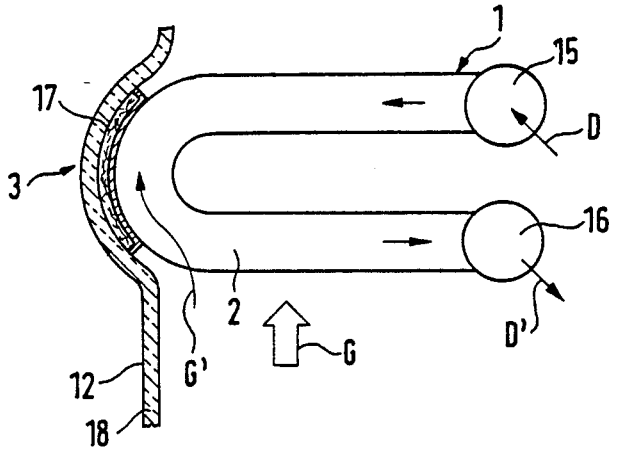
FIG. 3 is a sectional view of a detail of the heat exchanger showing a first embodiment of the invention.

In this respect, the sealing element 17 partially, or as illustrated in FIG. 3, completely envelops the curved outer portions of the tubes of matrix 1.

Figure 6:
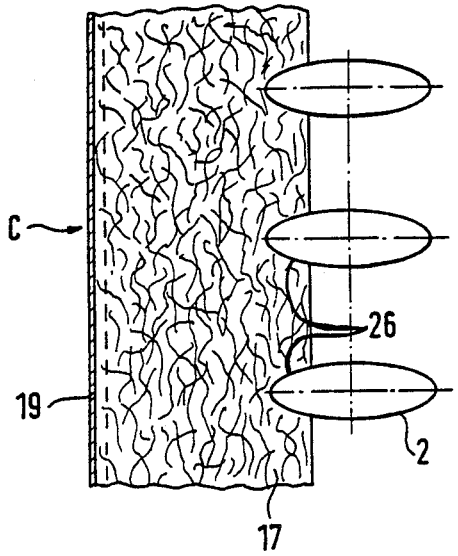
FIG. 6 is a cross-sectional view taken along line 6—6 in FIG. 9.
Figure 8:
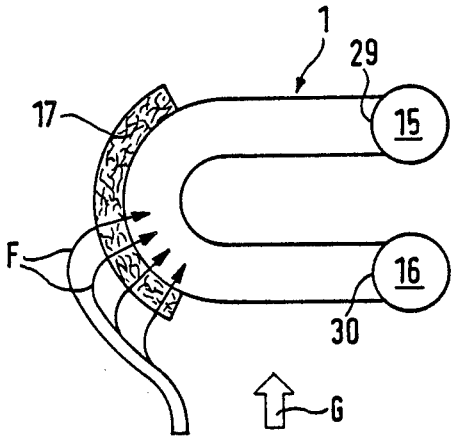
FIG. 8 is a sectional view taken on line 8—8 in FIG. 7 in relative arrangement with the matrix and the ducts in accordance with FIG. 6, especially also with FIG. 3.
Figure 9:
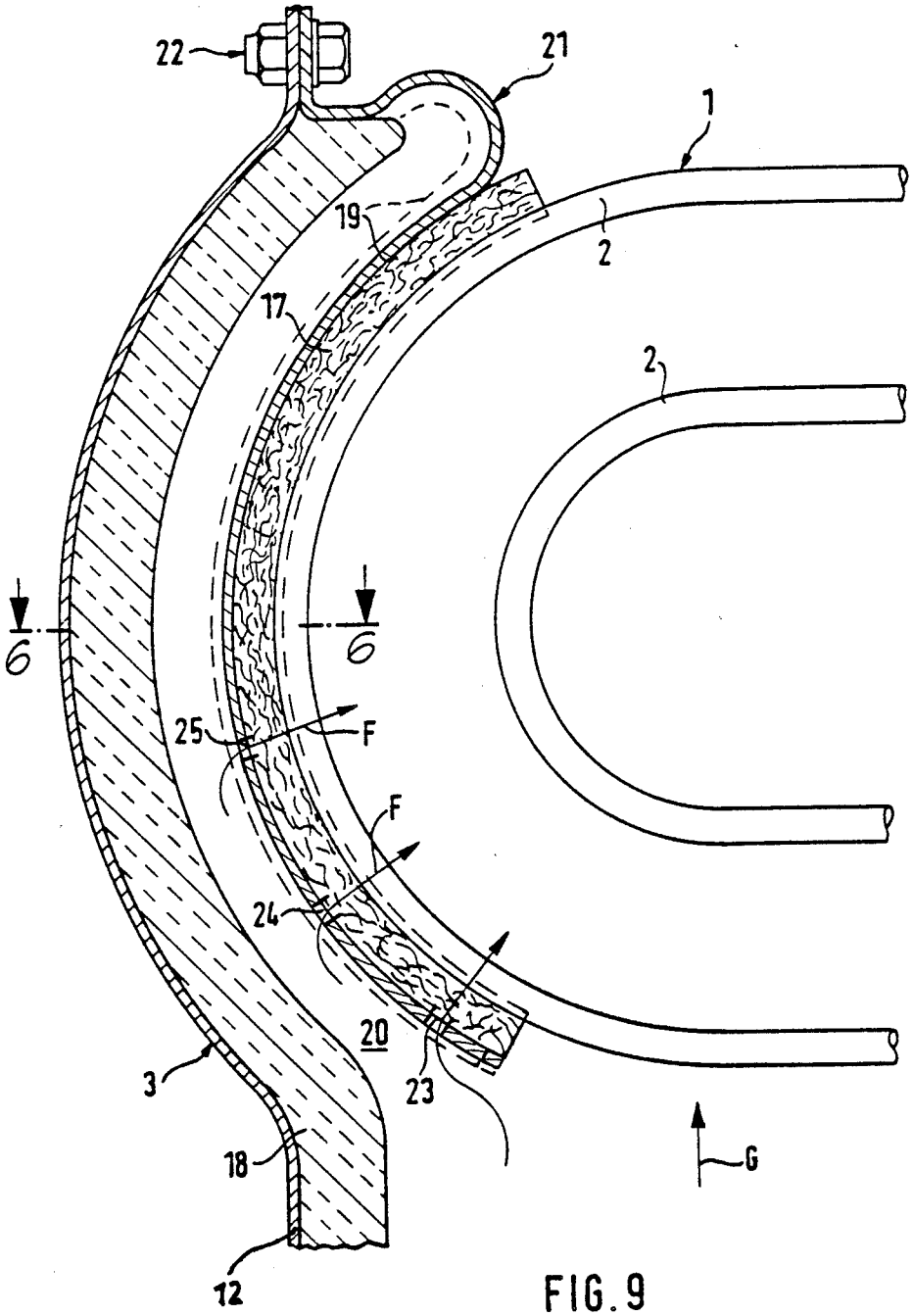
FIG. 9 is a view on enlarged scale, similar to FIG. 3, showing another embodiment of the invention in greater detail.

In FIGS. 6, 8 and 9 the sealing element 17 is shown in an advantageous construction in the form of a porous, flexible mat made of an elastic metal felt.

The flexible mat adapts itself to accommodate the relative movements of the individual bends of tubes 2, 2', 2'' of the matrix 1 as illustrated in FIG. 5 and is supported in a position to absorb or attenuate any vibrations of the ends of the tubes to serve as a vibration damping cushion.

As seen in FIG. 9, the wall 3 and the inlet and outlet of housing 12 are lined with a layer 18 of thermal insulation on the surface facing the tube matrix 1 and have particularly the sealing element 17 thereon in order to keep the housing 12 as cool as possible and prevent its exposure to appreciable, hot gas induced thermal expansions.

In accordance with FIG. 9, the sealing element 17 is in the form of a metal felt mat which is covered on the surface thereof facing away from the tube bends with a thin sheet 19 of impervious material (see also FIG. 6). The sheet 19 faces wall 3 and more particularly, layer 18 thereon to form a clearance passage 20 therewith. The passage 20 is open at the inlet of hot gases G (bottom of FIG. 9) and the outlet of the passage 20 is closed off by an outwardly bent section of the sheet 19 serving as a resilient seal 21. The bent section 21 of sheet 19 is secured to wall 3 by bolt connection 22. In this arrangement the contour of sheet 19 is shown in dotted lines to indicate the thermal compensation achieved in accordance with the present invention as a result of the resilient sealing element with its outwardly bent resilient seal 21. The sheet 19 can be a foil. The sheet or foil 19 can be comprised of individual sections joined to the metal felt mat 17 by brazing, crimping or clamping.

As seen in FIG. 9, the passage 20 is open at its inlet so that a portion of the main flow G of hot gases can be diverted into the passage 20 and it is especially advantageous to provide the sheet or foil 19 with apertures 23, 24, 25 which communicate with passage 20 and through which hot gases in passage 20 can flow to and through the metal felt mat to the bends of the tubes of the matrix 1. The hot gases in passage 20 are caused to flow over the bends of the tubes radially thereof. In this manner, a cross flow and counterflow heat exchange takes place at the bends of the tubes due to the main flow of gases G and the diverted flow of the gases from passage 20. The arrows F in FIG. 9 indicate the hot gas flow from passage 20 through the metal felt mat to the bends of the tubes 20 of the matrix 1.

Referring to FIG. 6, the metal felt mat of the sealing element 17 has contoured recesses 26 for receiving the bends of the outermost tubes 2 of the matrix 1. In this manner, further stabilization of the tube matrix can be achieved, especially in the outer bend region thereof where the compressed air undergoes deflection in the tubes. This will also improve the sealing action.

Figure 7:
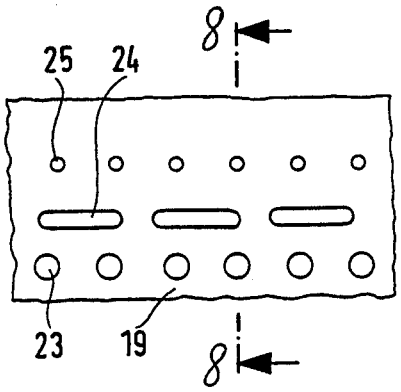
FIG. 7 is a view of a lined metal felt mat as seen in the direction of arrow C in FIG. 6.

As it will become apparent from FIG. 7, the apertures 23, 24, 25 can be sized and distributed in locally differing fashion in sheet or foil 19 such that a differential gas pressure prevailing in service can produce a load-dependent sealing force of the metal felt mat against the adjacent tubes 2 of the matrix 1.

Since the felt mat with its outer perforated sheet or foil 19 provides resistance to the flow of hot gas, the resistance can be varied, in accordance with the area and disposition of the apertures, so that the resulting pressure difference causes a force to act in the direction of the tube bends. This force improves the sealing action. The force is load-dependent. When the heat exchanger is used, for example, in a vehicular gas turbine, this provides the advantage that in the idle operation of the tubine and with the vehicle standing still, the seating force is moderate as there are no external forces to produce relative movements of the tube matrix whereas in driving operations, when shocks and vibrations may deflect the tube matrix, the seating pressure is raised as a result of the higher differential pressure $\Delta p$ at higher engine speeds and the tube matrix is stabilized.

In driving operations, therefore, the total mass flow through the gas turbine engine is increased. The equally increased seating pressure of the sealing element 17 results from the pressure difference $\Delta p$ between the hot gas ram pressure p developed on the one side in the gas passage 20 as a result of preselected throttle action via the apertures 23, 24, 25, which exceeds the hot gas pressure p′ in the matrix, behind the metal felt mat ($p > p'$).

Analogously to FIG. 9, the main flow direction of the hot gas is indicated in FIG. 8 by G, and the hot gas flowing through the sealing element 17 by F.

In the embodiments of FIGS. 3, 8 and 9, the separate compressed air ducts 15, 16 are formed by separate manifolds. As previously noted with reference to FIG. 10, a single duct or manifold 31 can accommodate both separate compressed air ducts 15, 16. In other respects, the construction of FIG. 10 is the same as that previously described and the wall 3 and the appropriate means between the wall and bends of the matrix can be provided as explained hereinabove.

As will also become apparent from FIG. 11, the individual tubes 2 of the matrix 1 are preferably aerodynamically shaped in cross-section as streamlined oblong bodies, each having two separate internal compressed air ducts 8′, 9′ separated from one another by an intermediate cross web 7′. Each of the compressed air ducts 8′, 9′ has a generally triangular shape which tapers upstream or downstream of the hot gas flow G. As evident from the array of the tubes 2 in the matrix in FIG. 11 the individual tubes in the rows of the matrix internest with one another in staggered arrangement to form streamline passages for flow of the hot gases G therearound.

As also evident in FIG. 10, a separate tube matrix can extend laterally from each side of manifold 31, and wall 3 and the appropriate sealing means between the wall and the bends of each matrix can be provided as previously explained.

Although the invention has been disclosed in relation to specific embodiments thereof, it will become apparent to those skilled in the art that numerous modifications and variations can be made within the scope and spirit of the invention as defined in the attached claims.

What is claimed is:

1. A heat exchanger comprising a plurality of U-shaped tubes assembled in internested, spaced relation in a matrix for conveying a first fluid through the tubes, means forming a flow path for a second fluid around the tubes of said matrix so that heat exchange takes place between the first and second fluids, said U-shaped tubes having bends for flow reversal of the first fluid in the tubes, said means which forms the flow path for the second fluid including a guide wall facing the bends of the tubes in the matrix to form a gap therewith and means including a flexible elastic sealing element between said guide wall and said bends of said tubes for blocking flow of said second fluid through said gap while permitting relative movement of said tubes with respect to one another and with respect to said guide wall, said sealing element comprising a flexible mat of elastic metal felt which extends over at least a portion of said bends of the tubes facing the guide wall.

2. A heat exchanger as claimed in claim 1 comprising thermal insulation means on said wall facing said bends of the tubes.

3. A heat exchanger as claimed in claim 1 wherein said means for blocking flow of the second fluid through said gap further includes a solid cover sheet secured on said mat facing said guide wall.

4. A heat exchanger as claimed in claim 3 wherein said cover sheet is a metal foil impervious to the second fluid.

5. A heat exchanger as claimed in claim 3 wherein said cover sheet is assembled on said mat in sections.

6. A heat exchanger as claimed in claim 3 wherein said cover sheet includes a bend portion secured to said wall to close off said gap and prevent flow of said second fluid through said gap.

7. A heat exchanger as claimed in claim 6 wherein said bend portion of the cover sheet provides resilience to enable relative movement of the mat and cover sheet towards and away from said wall.

8. A heat exchanger as claimed in claim 6 wherein said cover sheet provides an open inlet for said gap and said bend portion of the cover sheet closes off said gap at a location spaced from said inlet.

9. A heat exchanger as claimed in claim 8 wherein said cover sheet is provided with apertures for passage of said second fluid which is in said gap to said mat and therethrough to said bends of said tubes substantially radially thereof.

10. A heat exchanger as claimed in claim 9, wherein said apertures are dimensioned and distributed to produce sealing pressure of the mat against the bends of the tubes due to differential pressure between the second fluid which is in said gap and the second fluid which is in said flow path around the tubes.

11. A heat exchanger as claimed in claim 1 wherein said mat is provided with recesses in which said bends of the tubes are seated.

12. A heat exchanger as claimed in claim 1 wherein said sealing element provides an inlet for diverting a portion of the flow of said second fluid and including means for conveying the diverted second fluid in said gap to the bends of said tubes along a path having a component extending radially of the bends.

13. A heat exchanger as claimed in claim 1 comprising first and second ducts for respectively supplying said first fluid to the tubes and for discharging said first fluid from said tubes.

14. A heat exchanger as claimed in claim 13 comprising a common manifold for said ducts.

15. A heat exchanger as claimed in claim 13 wherein each of said ducts comprises a respective individual manifold.

16. A heat exchanger as claimed in claim 1 wherein each said tube has a streamlined, oblong cross-section in the direction of flow of said first fluid.

17. A heat exchanger as claimed in claim 16 wherein each tube includes a cross-web therein forming two internal ducts of generally triangular shape respectively tapering upstream and downstream of the flow of the second fluid.

* * * * *